US006138487A

United States Patent [19]

Hartung et al.

[11] Patent Number: 6,138,487

[45] Date of Patent: Oct. 31, 2000

[54] ROLL FOR INFLUENCING FLATNESS

[75] Inventors: Hans Georg Hartung, Pulheim; Hans-Peter Richter, Friedewald; Helmut Kühn, Kreuztal; Wolfgang Denker, Freudenberg; Klaus Klamma, Hilchenbach, all of Germany

[73] Assignee: SMS Schloemann-Siemag Aktiengesellschaft, Düsseldorf, Germany

[21] Appl. No.: 09/244,649

[22] Filed: Feb. 4, 1999

[30] Foreign Application Priority Data

Feb. 20, 1998 [DE] Germany ..... 198 07 115

[51] Int. Cl.[7] ..... B21B 13/14; B21B 29/00; B21B 31/07

[52] U.S. Cl. ..... 72/241.4

[58] Field of Search ..... 72/241.2, 241.4, 72/241.6, 241.8, 242.2, 242.4, 243.2, 243.4, 243.6, 224

[56] References Cited

U.S. PATENT DOCUMENTS

| | | | |
|---|---|---|---|
| 4,407,151 | 10/1983 | Gronbech | 72/241 |
| 4,651,547 | 3/1987 | Morel et al. | 72/241.6 |
| 4,658,621 | 4/1987 | Link et al. | 72/241.6 |
| 4,722,212 | 2/1988 | Ginzburg et al. | 72/241.4 |
| 5,007,152 | 4/1991 | Tomizawa et al. | 72/241.4 |

FOREIGN PATENT DOCUMENTS

| | | |
|---|---|---|
| 196 37 584 A1 | 3/1998 | Germany . |
| 2094687 | 9/1982 | United Kingdom . |

OTHER PUBLICATIONS

Patent Abstracts of Japan, vol. 006, No. 224 (M–170), Nov. 9, 1982 & JP 57 127507 A (Ishikawajima Harima Jukogyo KK) Aug. 7, 1982.

*Primary Examiner*—Rodney A. Butler
*Attorney, Agent, or Firm*—Friedrich Kueffner

[57] ABSTRACT

A roll, particularly a back-up roll, for rolling flat material is composed of a rotating roll shell and a unit arranged within the roll shell for influencing the bending stiffness of the roll shell. The unit for influencing the bending stiffness of the roll shell is a friction bearing in the form of a body of rotation. The body of rotation can be adjusted by rotating the body. The body of rotation is shaped in such a way that the load application surface thereof corresponding to the zone of the roll shell to which load is applied is part of the circumferential surface of a rotation-symmetrical body and the edge of this circumferential surface is shaped in such a way that along the circumference of the body of rotation the width and/or position of the load application surface vary.

5 Claims, 6 Drawing Sheets

ROLL FOR INFLUENCING FLATNESS

BACKGROUND OF THE INVENTION

1. Field of the Invention

The present invention relates to a roll, particularly a back-up roll, for rolling flat material. The roll is composed of a rotating roll shell and means arranged within the roll shell for influencing the bending stiffness of the roll shell.

2. Description of the Related Art

During the rolling process the rolling forces are applied by work rolls which rest on the flat material, for example, metal strip. The rolling forces must be distributed as uniformly as possible over the entire length of the roll, i.e., the line of contact between the circumference of the roll and the strip should be a straight line. The rolling stock interferes with obtaining the straight line, and this interference results in a zone of the roll to which a greater load is applied and in a crown of the roll.

In order to prevent this, back-up rolls are usually placed on the work rolls, wherein the back-up rolls must have a sufficient bending stiffness. In addition, in order to prevent the crown, systems are known in the art which change through hydraulic mechanisms the crown of a roll and in individual cases also the width of contact. In these systems, the crown and possibly also the resiliency of the roll relative to external loads along the crown are influenced by means of oil pressure cushions and/or hydraulically actuated support shoes and are adapted to the rolling conditions. Disadvantages of these systems are the sometimes very complicated high-pressure hydraulic units as well as problems with respect to tightness which result in contamination of the rolling oil or emulsion by the hydraulic oil. Moreover, the applications are limited by the structural size, so that these systems at the present time can be used exclusively as back-up rolls.

In addition, systems with displaceable rolls are known in the art for influencing the flatness and the profile during rolling of metal strip. In these systems, either the load distribution between the rolls is adjusted by a partial displacement of at least two rolls or the roll gap is influenced. In accordance with the continuous variable crown method (CVC-method), it is proposed to react to the formation of crowns of rolls by displacing suitably contoured rolls relative to each other.

It is also known in the art to use shell-type rolls as backup rolls which have a high bending stiffness in spite of their hollow interior. In this connection, German patent application 196 37 584.3 proposes to compensate bending of the shell-type rolls by means of friction bearings within the rolls. These friction bearings are, for example, spherical friction bearings mounted on a support axis or shaft, wherein the friction bearings can be arranged so as to be adjustable with respect to their spacing and securable in their position. The friction bearings are constructed as oil film bearings. However, the rolls of this type have the disadvantage that the compensation zone between the bearing shells in the interior of the roll and the shell of the back-up roll is predetermined by the respective bearing width, number of bearings and arrangement of bearings. Consequently, this system cannot operate without additional adjusting means for influencing the flatness.

U.S. Pat. No. 4,407,151 also proposes the mounting of support means in the hollow interior of a shell-type roll as a possibility for influencing the bending stiffness of the roll. For example, support discs mounted on a shaft are to be arranged at selected points along the length of the roll. The discs themselves can be displaced along the hollow interior of the roll by applying pressure. In addition, it is proposed that the roll shell receives a shaft with clearance fit or close fit. The adjustment to the flat material to be processed is achieved by displacing the respective shafts of two back-up rolls.

SUMMARY OF THE INVENTION

Therefore, it is the primary object of the present invention to provide a roll with bending stiffness which facilitates a simple and quick adjustment to a change of the rolling conditions, particularly a change of the strip width.

In accordance with the present invention, the means for influencing the bending stiffness of the roll shell is a friction bearing in the form of a body or solid of or generated by rotation. The body of rotation can be adjusted by rotating the body. The body of rotation is shaped in such a way that the load application surface thereof corresponding to the zone of the roll shell to which load is applied is part of the circumferential surface of a rotation-symmetrical body and the edge of this circumferential surface is shaped in such a way that along the circumference of the body of rotation the width and/or position of the load application surface vary.

Accordingly, the present invention proposes a roll which is composed of a rotating roll shell and a friction bearing arranged within the roll shell in the form of a body of rotation for influencing the bending stiffness of the roll shell. This body of rotation constitutes a counter-force to the load application zone of the roll shell produced by the rolling stock. The counter-force counteracts the crown of the roll or the work rolls.

The roll according to the present invention makes possible a quick and optimum adaptation to the changes of the rolling conditions.

The selection of the rotation-symmetrical body and of the shape of the edge of the load application surface are the result of computations and can be determined in dependence on the strip widths to be rolled and the necessary rolling force spectrum.

For example, the load application surface is part of the circumferential surface of a cylinder. The surface may also be curved, for example, following the contour of an ellipsoid or paraboloid. Moreover, it is conceivable that the load application surface has a certain pattern.

The body of rotation already manufactured in an adapted manner can be further adapted simply and quickly to varying metal strip widths and, thus, to loading forces which act on the roll shell by rotating the body of rotation.

As a result of the fact that the body of rotation or friction body is not mounted stationary but rotatably adjustable and as a result of the proposed geometric shape of the body, the load application surface in the contact zone with other rolls or the rolling stock can be rotated into that position in which the load application surface of the body of rotation corresponds approximately to the strip width to be processed and the resulting load application zone in the roll shell.

In order to further increase the adaptability of the body of rotation, another features of the present invention provides that the body of rotation has in the area of its load application surface a cutout whose edge and contour can be configured as desired. Also, several cutouts of this type may be provided. The configuration of the edge of the cutout and the contour thereof are also specifically computed, as is the case with respect to the edge of the circumferential surface of the body of rotation. These cutouts forming load relieving areas are advantageous when there is a simultaneous occurrence of middle waves and border waves or of quarter waves.

The body of rotation has edge areas which are located adjacent to the middle load application surface. These edge areas may also have any selected shape. In accordance with an advantageous feature, the conference of the edge areas decreases toward the ends of the body of rotation, for example, the edge areas are truncated cone-shaped. However, the shape of the edge areas does not absolutely have to be rotation-symmetrical.

In accordance with an embodiment of the invention, a single body of rotation is received in the roll shell. It is also conceivable that several bodies of rotation arranged next to one another are mounted within the hollow interior of the roll, wherein these bodies of rotation can be adjusted to the rolling conditions either individually or together by rotating them.

In accordance with another preferred feature, a body of rotation is used which is composed of several portions which engage fittingly into each other or can be moved away from each other.

The roll proposed in accordance with the present invention is advantageously used as a back-up roll. For example, four-high stands or other multiple roll stands are conceivable in this connection.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
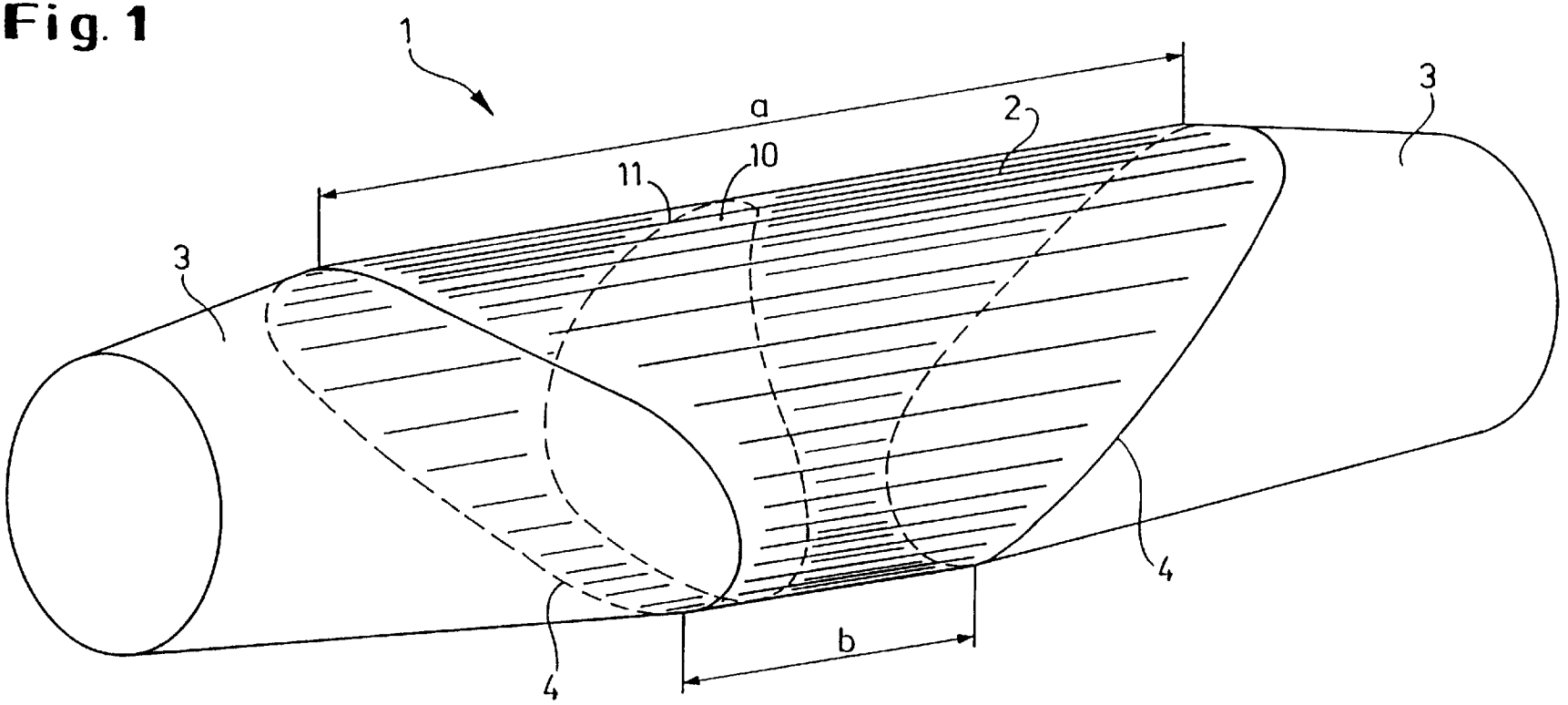
FIG. 1 is a schematic perspective view of a body of rotation in accordance with the present invention.
Figure 2:
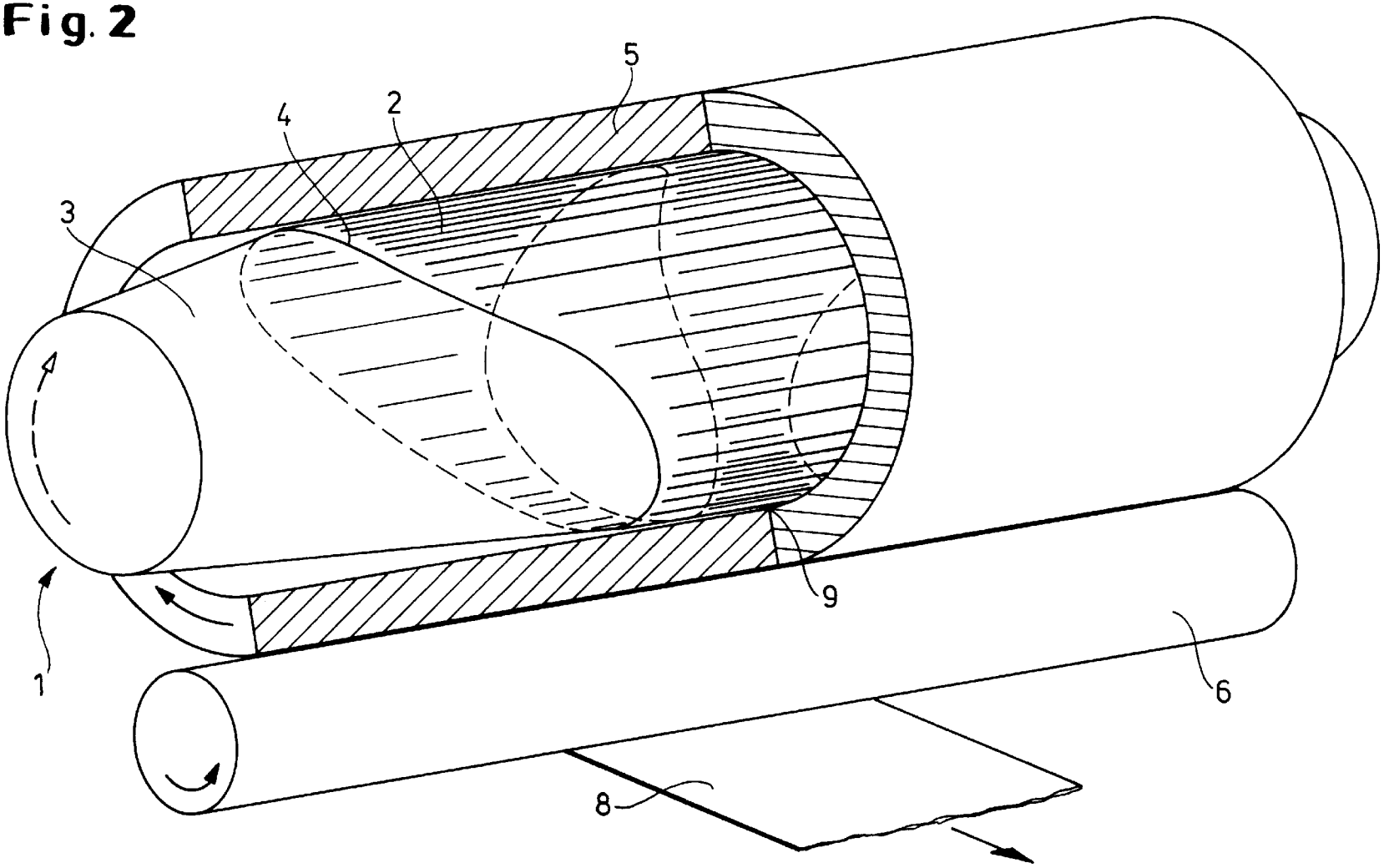
FIG. 2 is a schematic perspective view, partially in section, showing the upper half of a four-high set of rolls with a back-up roll composed of a roll shell and the body of rotation shown in FIG. 1.

FIG. 1 of the drawing shows an embodiment of the body of rotation 1 according to the present invention, while FIG. 2 schematically shows how the body of rotation 1 is mounted in the back-up roll of a four-high roll stand.

The body of rotation 1 has a middle load application surface 2 which constitutes part of the circumferential surface of a rotation-symmetrical body. In the illustrated embodiment, the specific circumferential surface is that of a cylinder. The edge of the circumferential surface is denoted by 4. The edge configuration is a consequence of a product program and is individually computed. In the illustrated embodiment, the edges 4 of the developed circumferential surface each form a sinusoid. This has the consequence that the distance of the edges between each other increases over the circumference of the body of rotation as indicated by distance a, and then once again decreases as indicated by distance b.

In addition to the middle load application zone 2, the body of rotation 1 has edge areas 3 connected to the load application surface 2. In the illustrated embodiment, these edge areas 3 are intersected obliquely at the cylindrical middle portion and are truncated cone-shaped. The cylinder and the obliquely intersected edge areas 3 have the same axis of rotation.

Provided in the rearward portion of the load application surface 2 of the body of rotation 1 is a cutout 10 indicated by broken lines. For example, the cutout can be produced by milling cutting of the body of rotation. In the illustrated embodiment, the cutout has a drop-shaped edge configuration 11. The contour of the cutout 10 in the interior of the body of rotation is not illustrated; it can have any configuration.

FIG. 2 of the drawing schematically shows the body of rotation 1 according to the present invention forming a friction bearing in a roll shell 5 which is shown partially cut away. The roll shell 5 rotates on a work roll 6, while the body of rotation is locked at a predetermined angle of rotation. The work roll 6 rests on the metal strip 8 to be rolled.

During the rolling procedure, the loads produced by the rolling stock have a disadvantageous effect on the crown of the work roll 6 and, thus, also on the flatness of the metal strip 8. The load application zone produced by the rolling stock and the outward bulging of the work roll 6 are subjected to a counter-force produced by the back-up roll, particularly by the body of rotation 1. By turning the body of rotation 1, it is adjusted and then secured in such a way that the optimum load application surface 2 of the body of rotation 1 for the occurring forces is used together with the load application zone 9.

Figure 3:
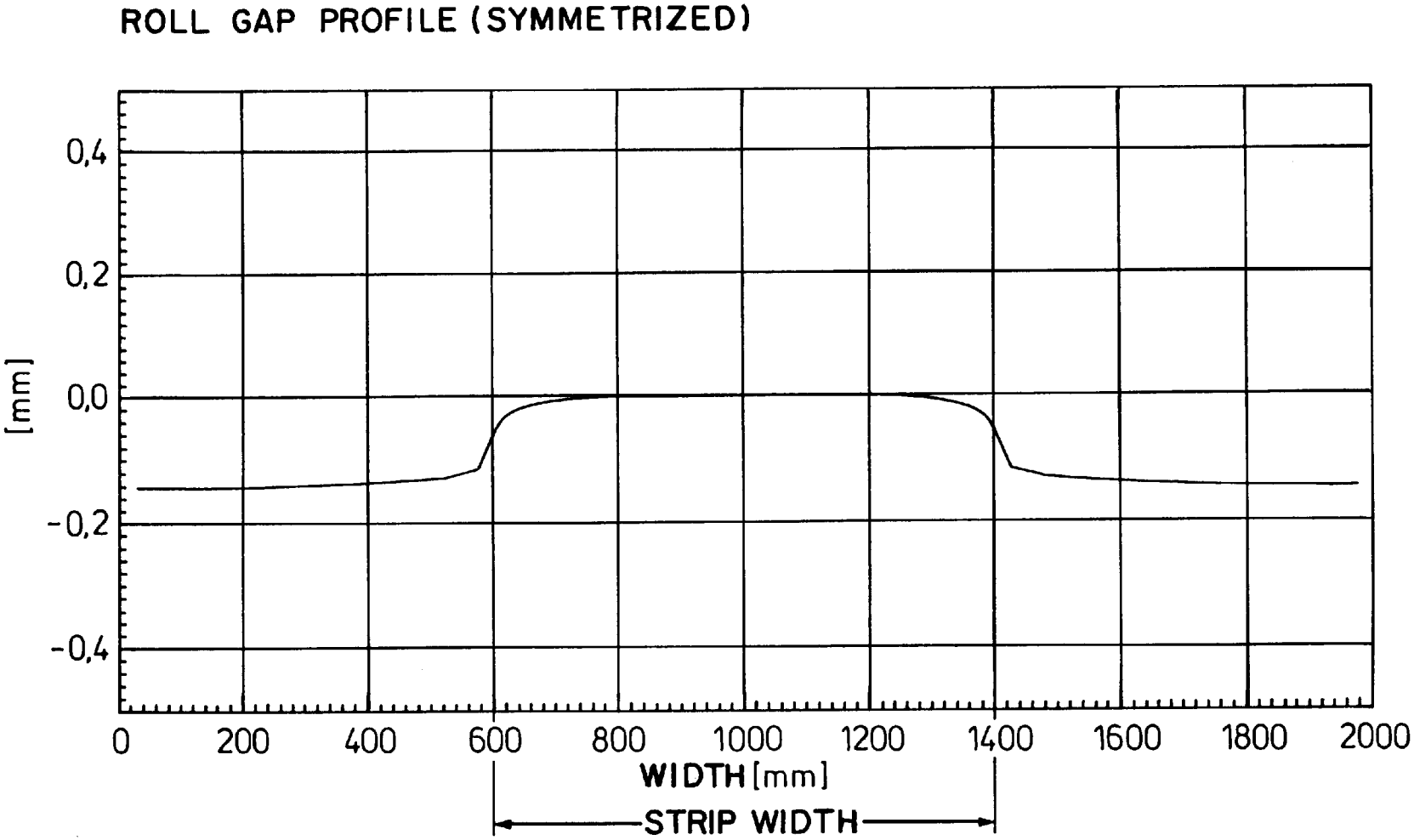
FIG. 3 is a diagram showing the roll gap profile over the strip width during the rolling procedure using the back-up roll arrangement shown in FIG. 2.

The diagram of FIG. 3 shows the roll gap profile during rolling of a metal strip having a width of 800 mm in a four-high stand [2,000 mm×420 mm (work roll) 1,500 mm (back-up roll)]. A back-up roll operating in accordance with the above-described principle was used. The width of the load application surface was selected narrower by 30 mm than the strip width. As a result of the use of the roll according to the present invention, an almost box-shaped roll-gap profile is obtained without the additional use of any other auxiliary means for influencing the roll gap profile, such as roll bending or displacing systems.

Figure 4:
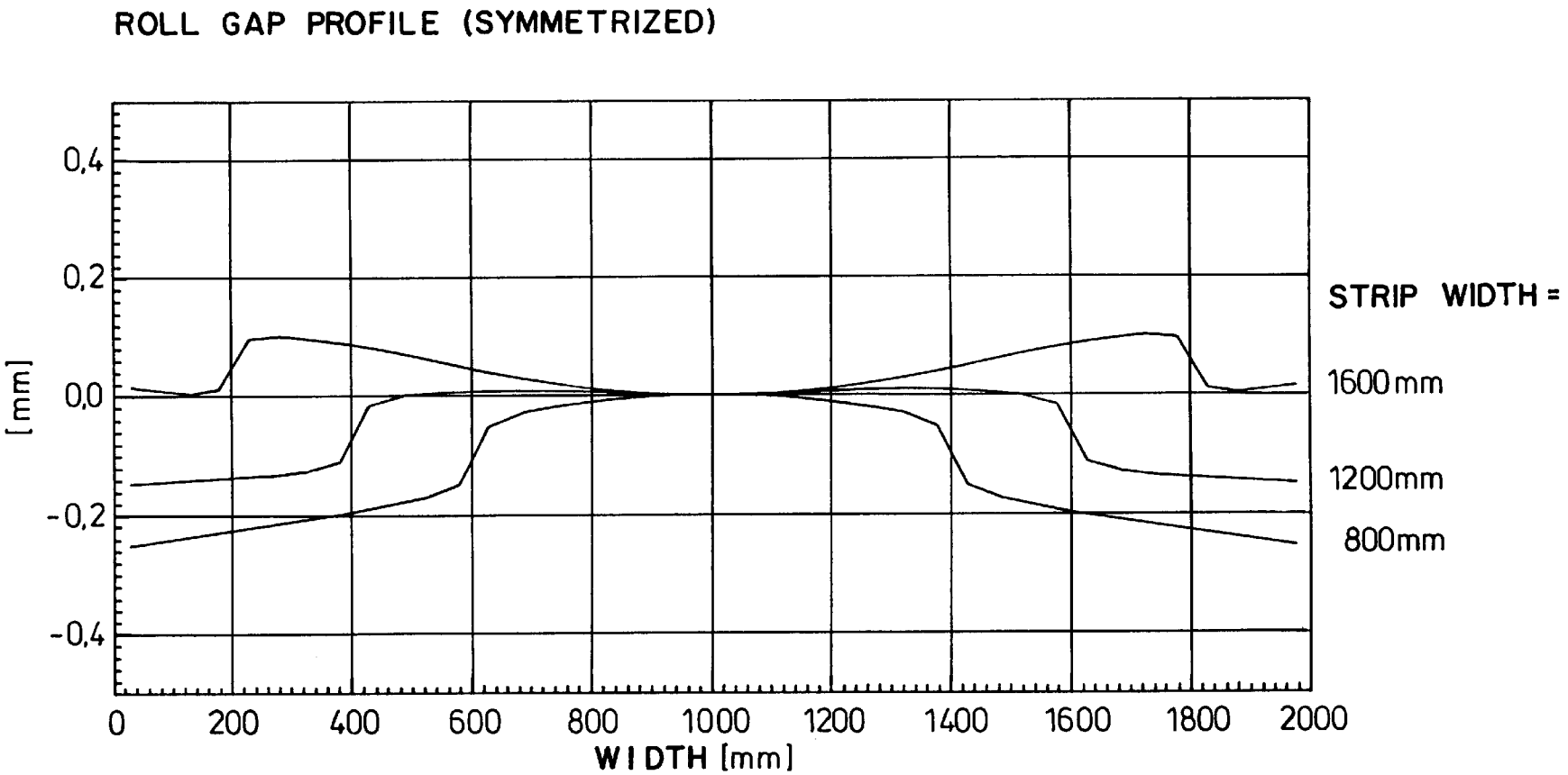
FIG. 4 is a diagram showing the roll gap profile over the strip width during the rolling procedure using a conventional back-up roll arrangement.

The diagram of FIG. 4 shows by way of comparison the roll gap profiles during the rolling process with a conventional back-up roll arrangement, wherein the crown influencing means is optimized for a strip having a width of 1,200 mm. It is apparent that the roll gap profiles are less box-shaped and, thus, less favorable.

Figure 5:
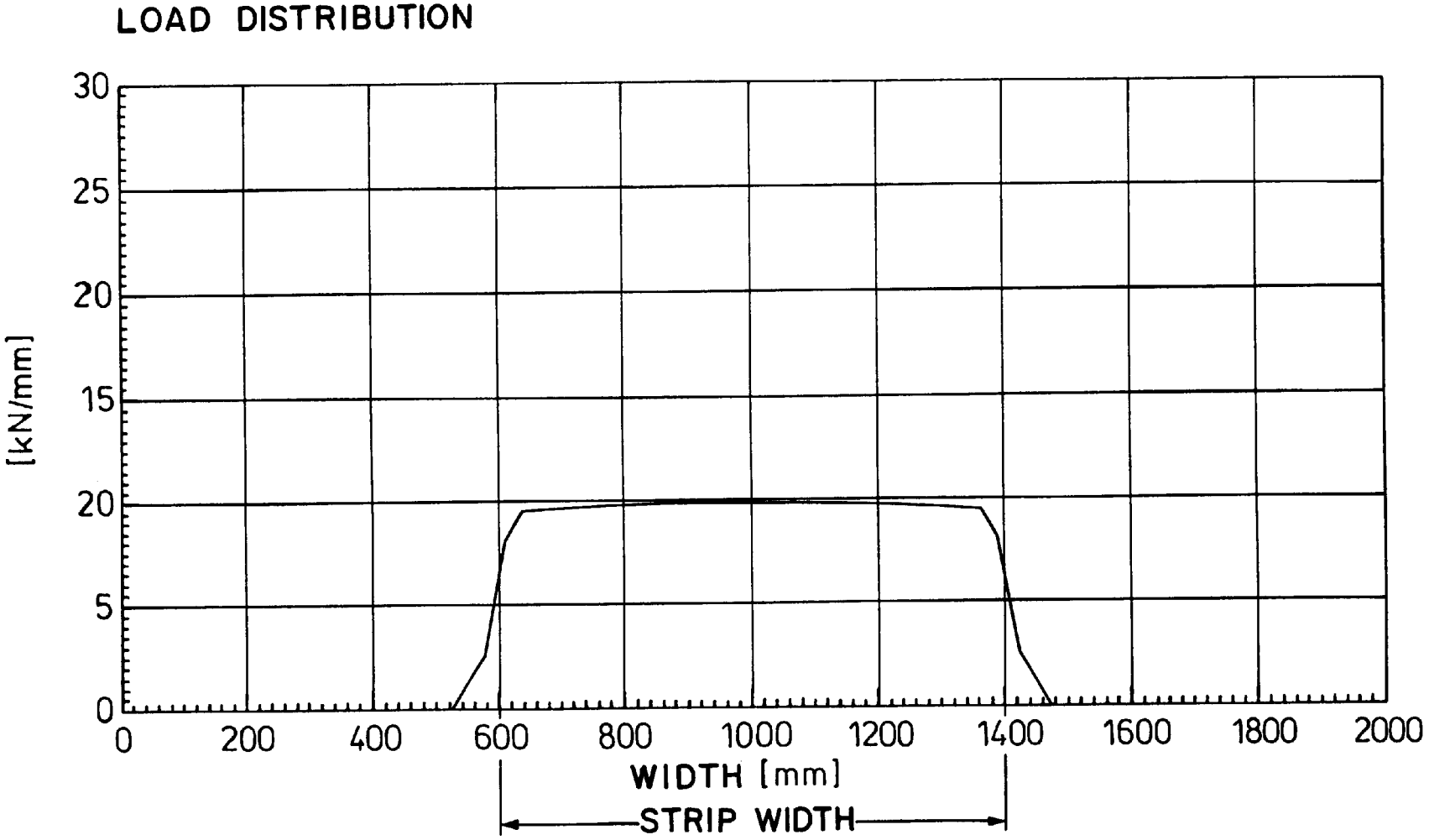
FIG. 5 is a diagram showing the load distribution between the body of rotation and the roll shell over the strip width.

The diagram of FIG. 5 shows the load distribution between the body of rotation and the roll shell over the strip width, which in the illustrated embodiment is 800 mm. The adjusted load application surface width is 770 mm.

Because of a suitably selected diameter pattern and curvature of the circumferential surface of the body of rotation, a uniform load pattern occurs between the load application surface and the rotating roll shell. This uniform load pattern is equivalent to an almost constant oil film thickness in the friction bearing and prevents undesired contacts with the friction bearing surfaces. In the present case, the shape of the middle portion of the body of rotation necessary for this purpose corresponded to a conventional crown of 0.4 mm diameter difference along the roll body (in relation to 2,000 mm). The middle portion of the body of rotation, i.e., the load application surface, is parabolically drum-shaped.

Not only the change of the strip width can be compensated with the aid of the proposed roll, but also the influences of changeable rolling forces. By rotating the body of rotation and the resulting adjustment of the load application surface, it becomes possible to react to various rolling forces and to produce a desired box-shaped roll gap profile as well as uniform loads acting on the bearings.

Figure 6:
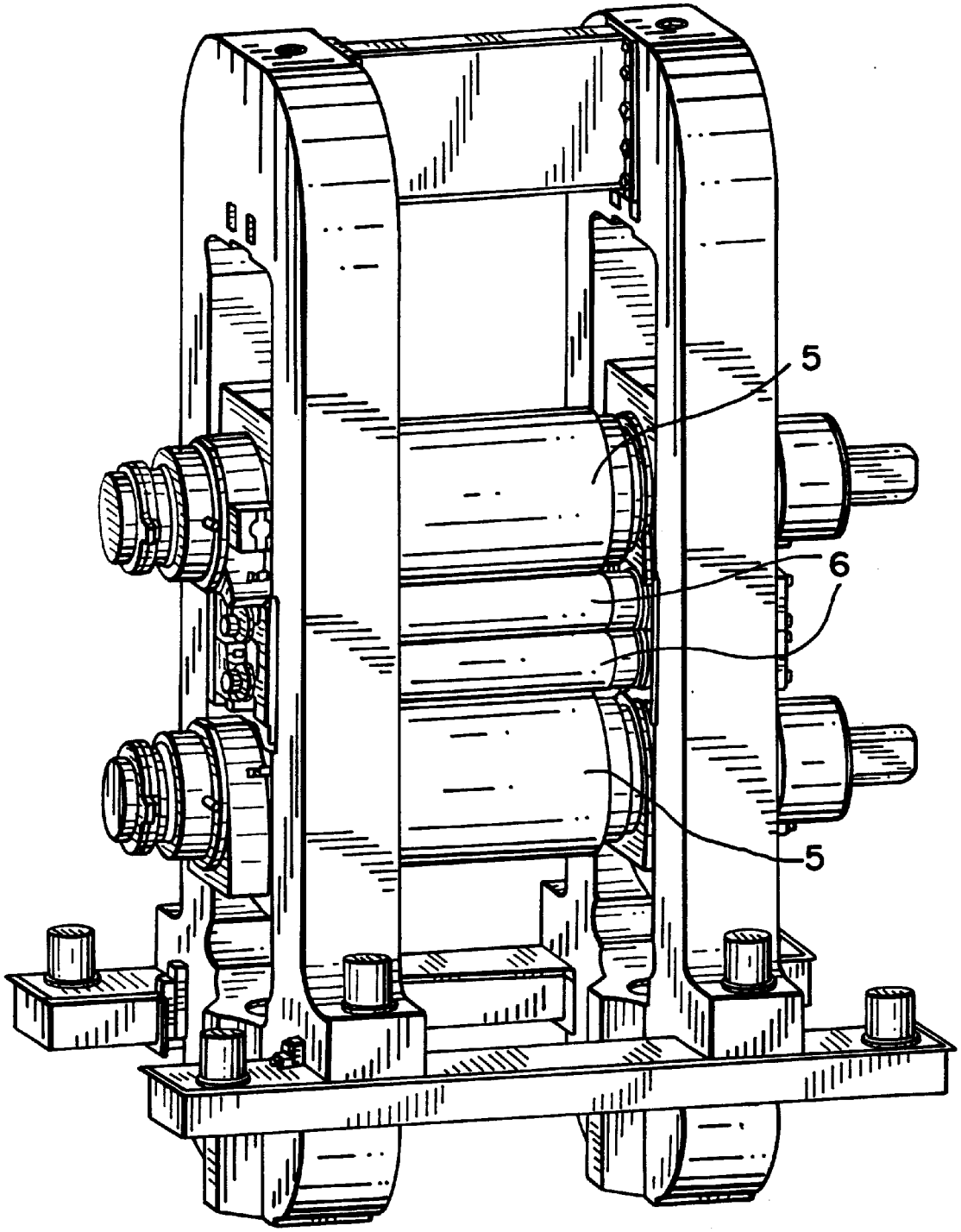
FIG. 6 is a perspective view showing a four-high roll stand.

FIG. 6 shows a roll stand with two work rolls 6 and two back-up rolls 5.

While specific embodiments of the invention have been shown and described in detail to illustrate the inventive principles, it will be understood that the invention may be embodied otherwise without departing from such principles.

We claim:

1. A roll comprising a roll shell which rotates during operation and means for influencing a bending stiffness of the roll shell mounted within an interior of the roll shell, the means for influencing the bending stiffness comprising a friction bearing comprised of at least one body of rotation mounted so as to be adjustable by rotation, the body of rotation being shaped such that a load application surface thereof corresponding to a load application zone of the roll shell is part of a circumferential surface of a rotation-symmetrical body, wherein the circumferential surface has an edge shaped such that at least one of a width and a position of the load application surface vary along the circumference of the body of rotation, wherein the body of rotation has in the load application surface thereof at least one cutout with an edge pattern and an internal contour, wherein the edge pattern and the internal contour are freely selectable.

2. The roll according to claim 1, wherein the body of rotation has edge portions contiguous with the load application surface, wherein a circumference of each edge portion decreases toward an end of the body of rotation.

3. The roll according to claim 1, wherein the roll is a back-up roll in a multiple roll stand for rolling strip material.

4. The roll according to claim 3, wherein the multiple roll stand is a four-high stand.

5. The roll according to claim 2, wherein the edge portions are truncated cone-shaped.

* * * * *